US008627638B2

(12) United States Patent
Anderson et al.

(10) Patent No.: US 8,627,638 B2
(45) Date of Patent: Jan. 14, 2014

(54) METHOD OF PACKAGING MEDIA USED IN A DOCUMENT PRODUCING DEVICE

(75) Inventors: Bradley J. Anderson, Boise, ID (US); William I. Herrmann, Court Eagle, ID (US); Leonard T. Schroath, Boise, ID (US); Bruce L. Johnson, Eagle, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1771 days.

(21) Appl. No.: 11/467,248

(22) Filed: Aug. 25, 2006

(65) Prior Publication Data

US 2007/0000661 A1 Jan. 4, 2007

Related U.S. Application Data

(62) Division of application No. 10/615,677, filed on Jul. 8, 2003, now Pat. No. 7,165,675.

(51) Int. Cl.
*B65B 61/18* (2006.01)
*B41J 13/10* (2006.01)

(52) U.S. Cl.
USPC ..... 53/412

(58) Field of Classification Search
CPC ..... B41J 13/0081
USPC ..... 53/492, 412, 133.5, 133.6, 133.7, 53/133.8, 411, 415; 206/424, 425, 449, 206/455, 459.1, 459.5; 229/122, 235, 240, 229/242
See application file for complete search history.

(56) References Cited

U.S. PATENT DOCUMENTS

| | | | | | |
|---|---|---|---|---|---|
| 3,302,851 | A | * | 2/1967 | Johnson | 206/424 |
| 3,367,487 | A | | 2/1968 | Dwyer, Jr. | |
| 3,767,188 | A | | 10/1973 | Rosenberg, Jr. et al. | |
| 3,987,902 | A | * | 10/1976 | Burgess et al. | 209/555 |
| 4,011,155 | A | * | 3/1977 | Feurstein et al. | 53/53 |
| 4,015,770 | A | | 4/1977 | Tamarin | |
| 4,782,956 | A | | 11/1988 | Yoshizawa | |
| 5,053,814 | A | * | 10/1991 | Takano et al. | 399/23 |
| 5,137,269 | A | * | 8/1992 | Yamamoto | 206/455 |
| 5,375,718 | A | | 12/1994 | Honma et al. | |
| 5,415,387 | A | | 5/1995 | Suzuki | |
| 5,819,924 | A | | 10/1998 | Sigrist et al. | |
| 5,989,724 | A | | 11/1999 | Wittosch et al. | |
| 6,536,968 | B2 | | 3/2003 | Lee et al. | |
| 6,546,210 | B1 | * | 4/2003 | Nakamura | 206/449 |
| 2002/0004732 | A1 | * | 1/2002 | Quigg | 705/7 |
| 2002/0136575 | A1 | | 9/2002 | Cornelius | |
| 2003/0164317 | A1 | * | 9/2003 | Fujiwara | 206/425 |

FOREIGN PATENT DOCUMENTS

| | | | | |
|---|---|---|---|---|
| EP | 1 099 639 | | 5/2001 | |
| GB | 2206555 | * | 1/1989 | |
| JP | 5-213525 | | 8/1993 | |
| JP | 7-101568 | | 4/1995 | |
| JP | 2003-95456 | | 4/2003 | |
| WO | WO 01/89957 | * | 11/2001 | |
| WO | WO 0181093 A2 | * | 11/2001 | B41J 13/10 |

OTHER PUBLICATIONS

"Paper Tips and Tricks" (Gemini Forms and Systems, Inc.) 2001. Paper Usage, item 1.*
"Great White Copy" (International Paper) 2005. Lower left corner.*
"Helpful Facts About Paper" (XEROX) Mar. 1999. Figure 4-3, p. 4-5.*
Definition 3b of Label, Webster's Ninth New Collegiate Dictionary, Merriam-Webster Inc., Springfield, MA, USA, 1986, p. 668.*

* cited by examiner

*Primary Examiner* — Stephen F Gerrity

(57) ABSTRACT

A media wrapper for use in a printing device includes a first end, a second end, and a perforation disposed between the first and second ends, wherein the perforation is configured to split the media wrapper separating the first and second ends.

7 Claims, 10 Drawing Sheets

METHOD OF PACKAGING MEDIA USED IN A DOCUMENT PRODUCING DEVICE

This is a division of application Ser. No. 10/615,677, filed Jul. 8, 2003, now U.S. Pat. No. 7,165,675.

BACKGROUND

An important step in the production of a printed image on a print media is the feeding of a print media into a printing device. A number of methods have been developed to facilitate the introduction of print media into printing devices including: incorporating perforated paper, continuous feed fan-fold paper, various containment structures, etc. A recent trend has developed eliciting the ability to form images on numerous different media types. These different media types include envelopes, transparencies, card stock paper, and regular letter paper. These different media types are packaged in large quantities called reams so as to provide a convenient amount of media to a printing device.

In order to utilize a printing device, one would obtain a ream of print media, remove its wrapper, and insert it into a tray or cassette in the printing device. This process is performed on most printers and other document producing devices on a regular basis in order to keep a substantial amount of media in the printers and at hand for the user. Often in the tearing away of the wrapper on a ream of media, the media itself becomes disheveled and what could have been a virtually menial task turns into a desperate mess.

Moreover, with the ever increasing printing methods and media types, there is a greater demand for a high quality appearance of the produced document itself. In order to appease the demand for quality, media manufactures have applied a standard wherein there is a top and bottom to a ream of media. The quality of the image produced will depend on the side of the print media chosen. During the manufacturing process, the two sides of a piece of paper develop different characteristics and one side becomes better suited for receiving a print image. This is differentiation in the characteristics is often referred to as the nap of the paper. A ream is traditionally packaged with the nap facing the bottom of the ream of paper so as to signal to the user how to insert the media into the tray or cassette of the document printing device. When the user removes the wrapper of the media, the different faces of the media become virtually indistinguishable and, if the user fails to remember which side is which, the potential of receiving the highest print image quality is lost.

SUMMARY

A media wrapper for use in a printing device includes a first end, a second end, and a perforation disposed between the first and second ends, wherein the perforation is configured to split the media wrapper separating the first and second ends.

BRIEF DESCRIPTION OF THE DRAWINGS

The accompanying drawings illustrate various embodiments of the present invention and are a part of the specification. The illustrated embodiments are merely examples of the present invention and do not limit the scope of the invention.

Figure 1:
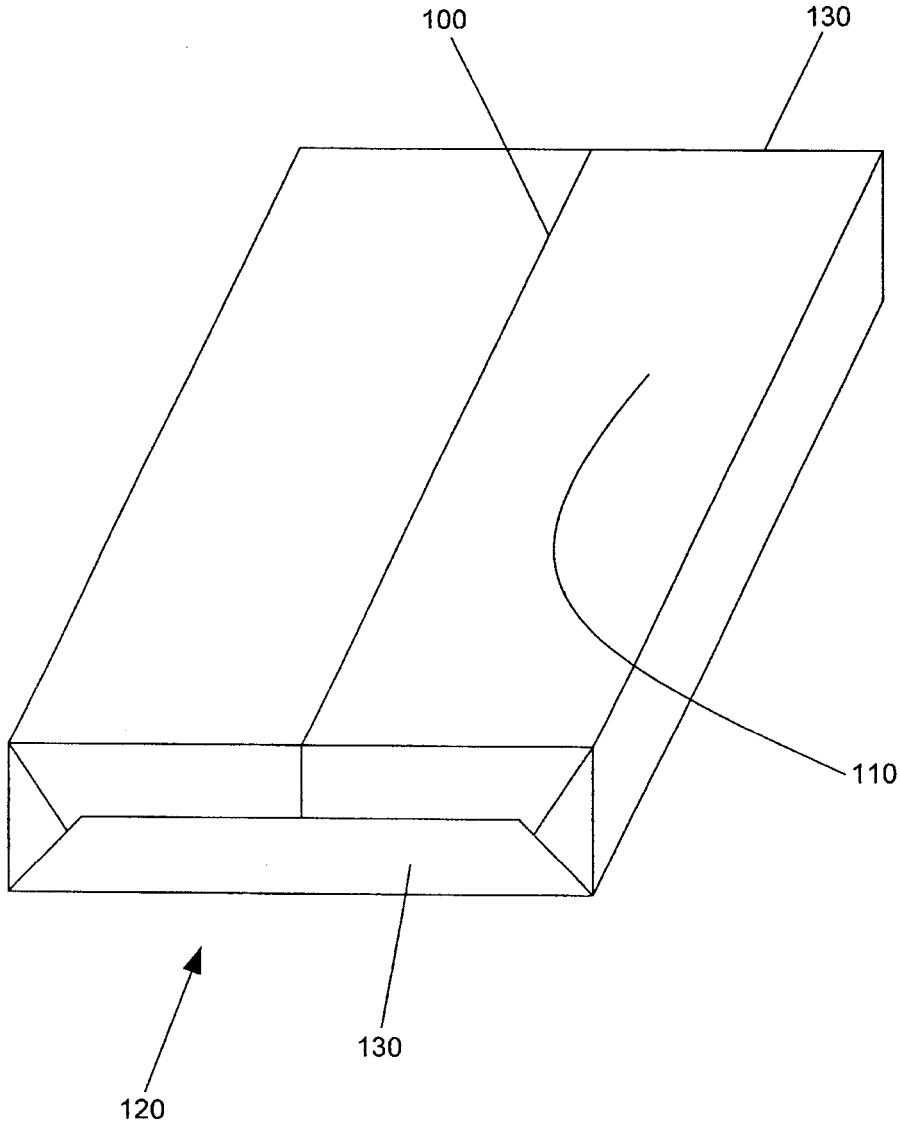
FIG. 1 illustrates a ream of print media according to one exemplary embodiment.

Throughout the drawings, identical reference numbers designate similar, but not necessarily identical, elements. While the invention is susceptible to many modifications and alternative forms, specific embodiments have been shown by way of example in the drawings and are herein explained in detail. It should be understood, however, that the description herein of specific embodiments is not intended to limit the invention to the particular forms disclosed, but on the contrary, the intention is to cover all modifications, equivalents, and alternatives falling within the sprit and scope of the invention as defined by the appended claims.

DETAILED DESCRIPTION

A system and a method for packaging a print media to increase convenience to the user when loading the print media in a printing device are presented below. More specifically, a print media wrapper is described that allows for a partial removal of the wrapper, thereby exposing print media to a pickup mechanism of a printing device while maintaining organizational support to the print media. The term "print media" is meant to be understood, both here and in the appended claims, as any object that may be packaged in a ream format to facilitate its reception by a printing apparatus including, but in no way limited to, envelopes, card stock, transparencies, labels, paper, or optical disks (compact disks or digital video disks). The present print media packaging system will be described herein, for ease of explanation only, in the context of a ream of paper configured to be introduced to a printer. However, the present print media wrapper may be used with the above-mentioned print media and may similarly be incorporated in any number of printing devices including, but in no way limited to, printers, copiers, scanners, or facsimile machines.

In the following description, for purposes of explanation, numerous specific details are set forth in order to provide a thorough understanding of the print media wrapper. It will be apparent, however, to one skilled in the art that the print media wrapper may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Turning now to FIG. 1, a ream of paper, or any other media wherein a print media wrapper (120) may be used to prevent dishevelment of the media, is depicted. As shown in FIG. 1, a typical print media wrapper (120) may include a seam (100) and a plurality of end portions (130). The seam (100) may, according to manufacturing specifications, indicate the bottom side (110) of the ream of print media contained therein.

The seam (100) illustrated in FIG. 1 may be used to distinguish which side of the ream should be up or down as dictated by the nap of the print media. The nap of a print media refers to differing surface textures of opposing print media surfaces. During the manufacture of certain print media, there exists a side of the print media wherein a printed image would have an improved appearance. This side differentiation is often referred to as the nap of the paper. The wrapper (120) of a ream of media, by way of the seam (100) of the wrapper (120), may indicate the nap of the print media. Alternatively, a distinguishing label (220; FIG. 2) or mark may be placed on the wrapper (120) to inform the user which side of the ream should be placed up or down according to the nap of the print media. With the aid of the seam (100) and/or label (220), a user may easily identify and correctly orient a ream of print media when inserting the print media into a tray or cassette of a printing device. A more desirable image is produced if the top side, and not the bottom side (110) where the nap exists, receives the image or text during the printing process. Hence, manufacturers have determined that the bottom side (110), or the side in conjunction with the wrapper seam (100), is the bottom and is not the preferred image receiving side for the production of single sided print jobs.

Traditionally, when a ream of print media was to be inserted into a tray or a cassette of a printing device, the entire wrapper (120) was removed. This removal of the wrapper (120) caused the top and the bottom of the ream of print media to become indistinguishable and the ability to identify the nap of the print media was lost. Moreover, the removal of the entire wrapper (120) eliminated the organizational support provided by the wrapper (120) to the print media. With a portion of the wrapper (120) still intact, the user may know exactly which side is to be up and which side is to face down while maintaining organizational support of the print media.

Figure 2A:
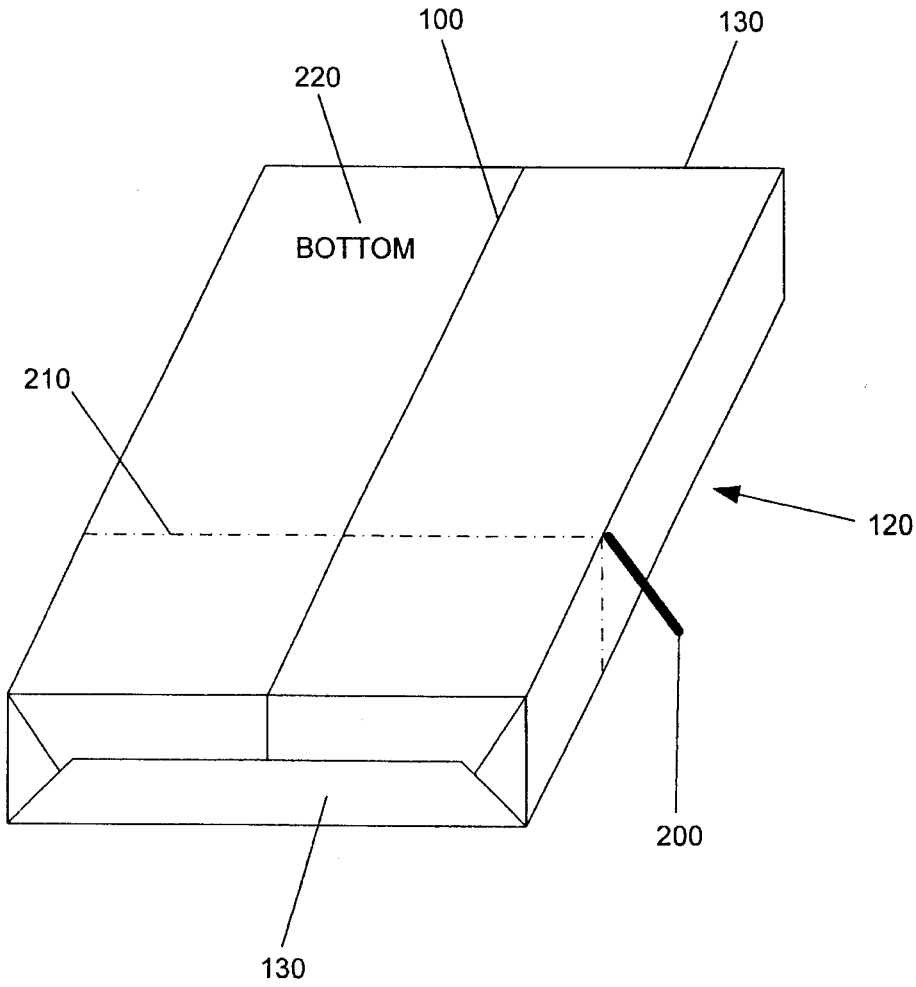
FIG. 2A is a perspective view of a ream of print media including a tear away portion according to one exemplary embodiment.

FIG. 2A illustrates an exemplary embodiment of a system and a method for removing only a portion of a print media wrapper (120) prior to its insertion into a printing device. As shown in FIG. 2A, a pull-tab (200), such as an extruded plastic ribbon, may be employed along a slot-cut or perforated seam (210) that runs perpendicular to the wrapper seam (100). When the pull-tab (200) is pulled, the tab may traverse the perforated seam (210) causing a somewhat precise split in the print media wrapper (120). With the print media wrapper (120) being split along the perforated seam (210), a portion of the print media wrapper (120) may then be easily removed.

While the embodiment illustrated in FIG. 2A depicts a plastic pull-tab (200) as the means for causing the somewhat precise split along the perforated seam (210), any type of pull tab that is structurally sufficient to tear the print media wrapper (120) along the perforated seam (210) may be incorporated including, but in no way limited to, a string, a plastic ribbon, or a ribbon of a heavier paper than that of the print media wrapper (120). Moreover, the print media wrapper may be manufactured according to a number of methods. According to one exemplary embodiment, the perforated seam (210) may be formed in the print media wrapper (120) prior to wrapping the ream of print media. Upon formation of the print media wrapper (120) and prior to packaging the ream of print media, the pull-tab (200) may be disposed on the print media wrapper. The pull-tab (200) may either be coupled to the print media wrapper (120) with an adhesive or it may be positioned around the print media ream prior to assembly. Once assembled, the pull-tab (200) may be positioned along the perforated seam (210) such that the pull-tab (200) is externally accessible to the user as illustrated in FIG. 2A.

Figure 2B:
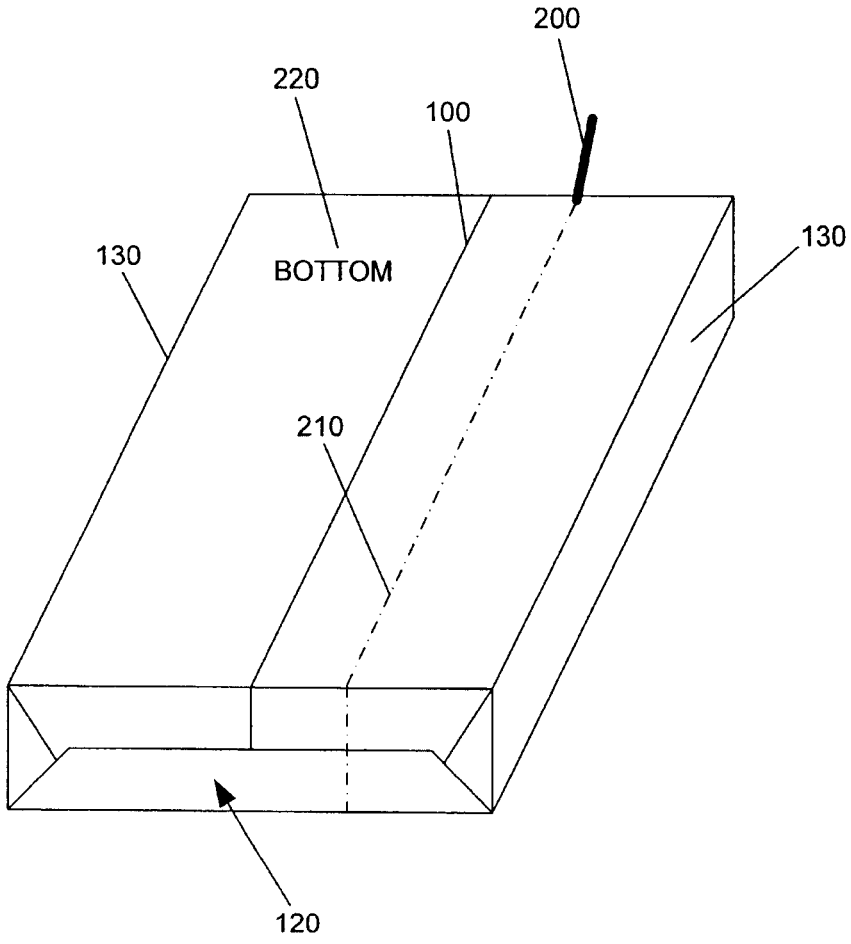
FIG. 2B is a perspective view of a ream of print media including a landscape tear away portion according to one exemplary embodiment.

FIG. 2B illustrates another exemplary embodiment of the present system for removing only a portion of a print media wrapper (120). As shown in FIG. 2B, the perforated seam (210) may be disposed parallel to the wrapper seam (100). When the perforated seam (210) illustrated in FIG. 2B is separated by a pull tab (200), a somewhat precise split may be formed lengthwise on the print media wrapper (120) allowing for the removal of a portion of the print media wrapper. According to the exemplary embodiment illustrated in FIG. 2B, when a portion of the print media wrapper (120) is removed, a landscaped orientation of print media may be exposed. While FIGS. 2A and 2B illustrate alternative orientations of the perforated seam (210), any orientation may be incorporated according to the present system to accommodate the media retrieval methods of various printing devices.

Figure 3:
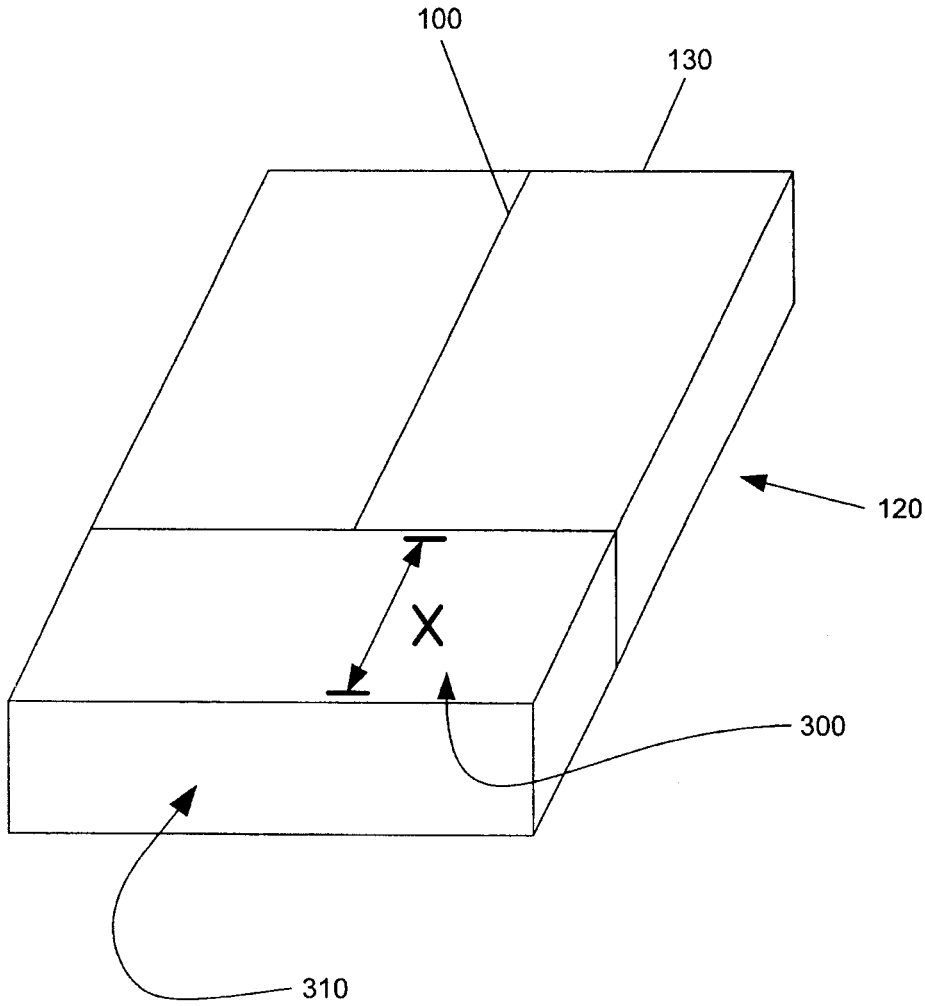
FIG. 3 is a perspective view of a ream of media illustrating an exposed section of media according to one exemplary embodiment.

When the pull-tab (200) is extracted and the print media wrapper (120) is split along the perforated seam (210), a portion of the print media wrapper (120) may be removed thereby exposing a portion of the ream of print media (300) as illustrated in FIG. 3. As shown in FIG. 3, the perforated seam (210; FIG. 2A) and the pull-tab (200; FIG. 2A) may be positioned such that when they are implemented, a portion of the print media wrapper (120) may be removed to expose a sufficient amount of the print media "X" (300) to be picked up by a pick-up mechanism of the document producing device (not shown). The amount of print media exposed (300), equal to the distance from the edge of the newly exposed media (310) to the remaining portion of the print media wrapper (120), may be sufficient for a pick up mechanism of a printing device to contact and remove a single unit of media without contacting the print media wrapper (120). Contact between the pick up mechanism and the print media wrapper (120) may prevent or disrupt the function of the pick-up mechanism.

Removing only the least acceptable amount of print media wrapper (120) from the ream of print media necessary to avoid contact between the print media wrapper (120) and the pick up mechanism of a printing device will provide a maximum ease of loading the print media to the user. By removing only the least acceptable amount of print media wrapper (120), a maximum amount of print media wrapper may remain around the print media providing organizational support as well as indicating the nap of the print media. This print media wrapper will allow a user to load the print media into a tray or cassette of a printing device without a disheveling of the media. Moreover, the remaining print media wrapper (120) may also display information to a user without necessitating a removal of the print media. By way of example, the remaining print media may include a tag or a label (not shown) that indicates print media qualities including, but in no way limited to, the quality, the color, the type, the brightness, the manufacturer, the recycling content, and/or the texture of the media contained therein. The tag or label may remain on the print media wrapper (120) and be visible to a user after its installation in a printing device. The tag may then aid in providing the user with print media information without having to disrupt the image forming process.

Figure 4:
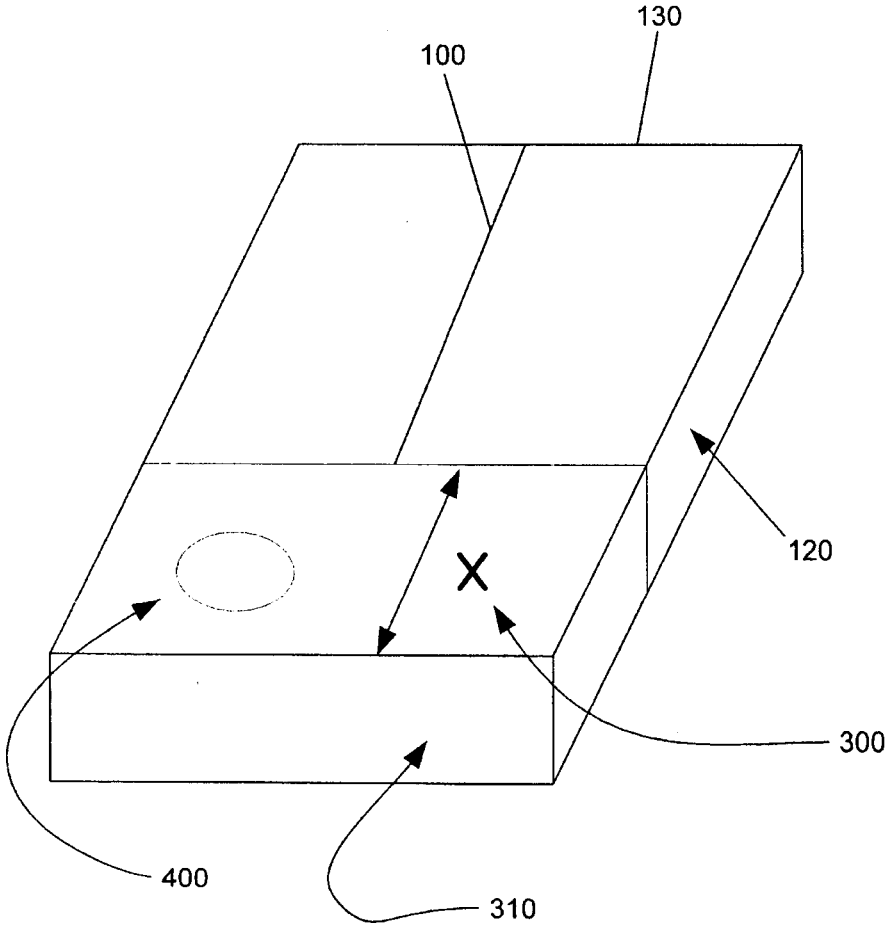
FIG. 4 is a perspective view of a ream of print media indicating a location where a pick-up mechanism of a document printing device may contact the print media according to one exemplary embodiment.

FIG. 4 illustrates one of the many different sites (400) where a pick-up mechanism may contact a ream of exposed print media (310) to remove a single unit of print media. The site (400) must be exposed from the wrapper (120) in order for the pick-up mechanism to function properly. The site (400) illustrating where the pick-up mechanism may contact the ream of exposed print media (310) is only exemplary and may vary in location to any point on the exposed print media (310) as dictated by the specific printing device being used.

Figure 5:
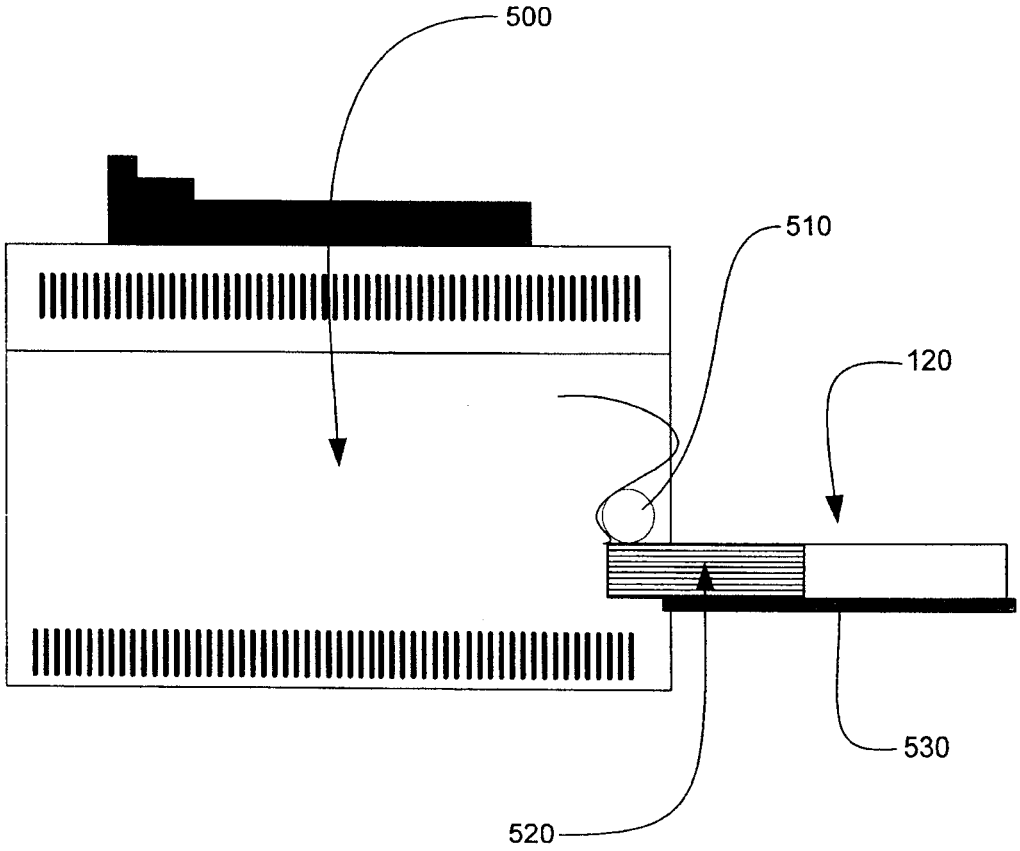
FIG. 5 is a schematic view of a print media incorporated in a printing device according to one exemplary embodiment.

FIG. 5 is a diagram of a printing device (500) incorporating the present print media wrapper (120; FIG. 2). As shown in FIG. 5, print media (520) may be inserted into a tray or cassette (530) of a printing device (500). The print media (520) may, as discussed above, be exposed to a pick-up mechanism (510) of the printing device (500) on one end and contained by a print media wrapper (120) on the other end. The diagram of FIG. 5 shows that a sufficient amount (300; FIG. 3) of print media wrapper (120) has been removed from the ream of print media exposing a sufficient amount of print media for the pick-up mechanism (510) of the printing device (500) to retrieve a unit of print media from the tray (530). When a stack of print media (520) is inserted into the printing device (500), the pick-up mechanism (510) retrieves one unit of print media from the stack (520) and pulls it into the printing device (500) in order to attach an intended image onto the single unit of print media.

Having only a portion of the print media exposed to the pick-up mechanism (510) does not hinder the print media retrieval process. Rather, by maintaining a portion of the print media wrapper (120) on the print media throughout the printing process, the media in a stack (520) is more secure. Additionally, the remaining portion of print media wrapper (120) aides the user by facilitating the removal from and insertion to the printing device (500) of either a full or partially depleted ream of print media. Removal and insertion are facilitated by the remaining portion of the print media wrapper because the remaining print media wrapper (120) keeps the print media in a single stack preventing it from becoming disheveled. This allows a partially depleted ream of print media to be removed from a document printing device (500) and to be temporarily replaced by a different print media type, if a print job so requires.

Figure 6:
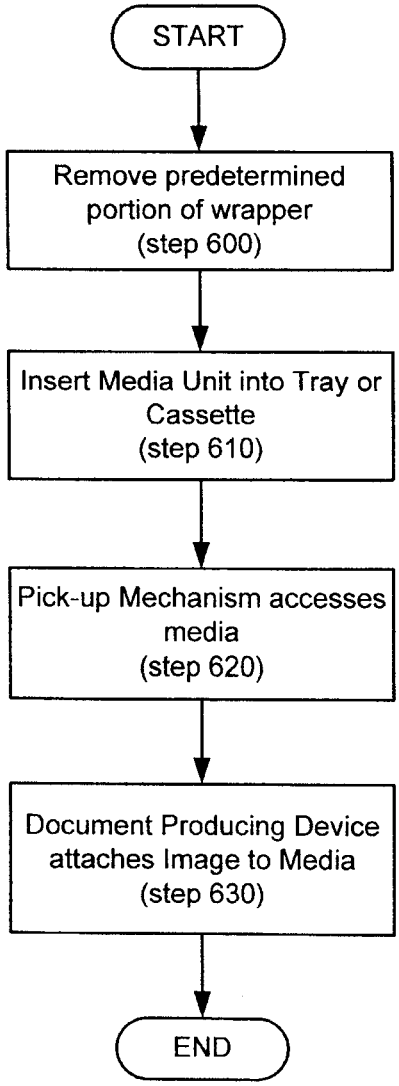
FIG. 6 is a flow chart depicting a method for using a print media with a partial wrapper in a printing device according to one exemplary embodiment.

FIG. 6 is a flow chart illustrating how a user would go about producing a document in a printing device (500; FIG. 5) using media bound by the present print media wrapper. As shown in FIG. 6, a user would begin by removing a portion of the print media wrapper (120; FIG. 2) from the ream of print media (step 600). The amount of print media wrapper (120; FIG. 2) removed from the ream of print media may be predetermined by the location of the perforated seam (210; FIG. 2). The splitting of the perforated seam may be performed by a pull tab (200; FIG. 2), as described above, or by any other sufficient removal device. Once the perforated seam has been split and the print media wrapper (120; FIG. 2) is in two separate pieces, a piece of the print media wrapper corresponding to the side of the print media that will be introduced to the pick-up roller may be removed and discarded.

With a portion of the print media wrapper (120; FIG. 2) removed from the ream of print media, the print media may be inserted into a tray or cassette of the printing device (step 610). The remaining print media wrapper (120; FIG. 2) will provide organizational support to the ream of print media while it is being inserted into a tray or cassette of the printing device (500; FIG. 5). The print media may be inserted into the tray or cassette by placing the side of the print media wrapper having a seam (100; FIG. 2) down in the tray or cassette if doing so will comply with the nap conditions discussed previously. The tray or cassette of the printing device may then be secured to the printing device to enable the document production process. While the present embodiment is described in the context of a printing device (500; FIG. 5) requiring the seam to be down to access the preferred side of the print media, the correct orientation of the print media is dependant upon the configuration of the printing device (500; FIG. 5) and may vary accordingly.

With the tray or cassette in place, a pick-up mechanism (510; FIG. 5) may come into contact with and retrieve a required amount of print media from the tray or cassette (step 620). As shown in FIG. 5, the pick-up mechanism (510) contacts the exposed print media (520) without contacting the remaining print media wrapper (120). This allows the print media wrapper to remain in the tray or cassette (530) and to provide support to the print media without interfering with the media picking process.

Once the pick-up mechanism (510) has retrieved a unit of print media (520) from the tray or cassette (530), the pick-up mechanism may then provide the print media to the printing device where a desired image may be secured to the print media producing a desired image (step 630; FIG. 6). When the print media contained in the tray or cassette is extinguished, the empty print media wrapper (120) may then be removed from the tray or cassette (530) and a new ream of print media and its wrapper placed in its stead.

Figure 7:
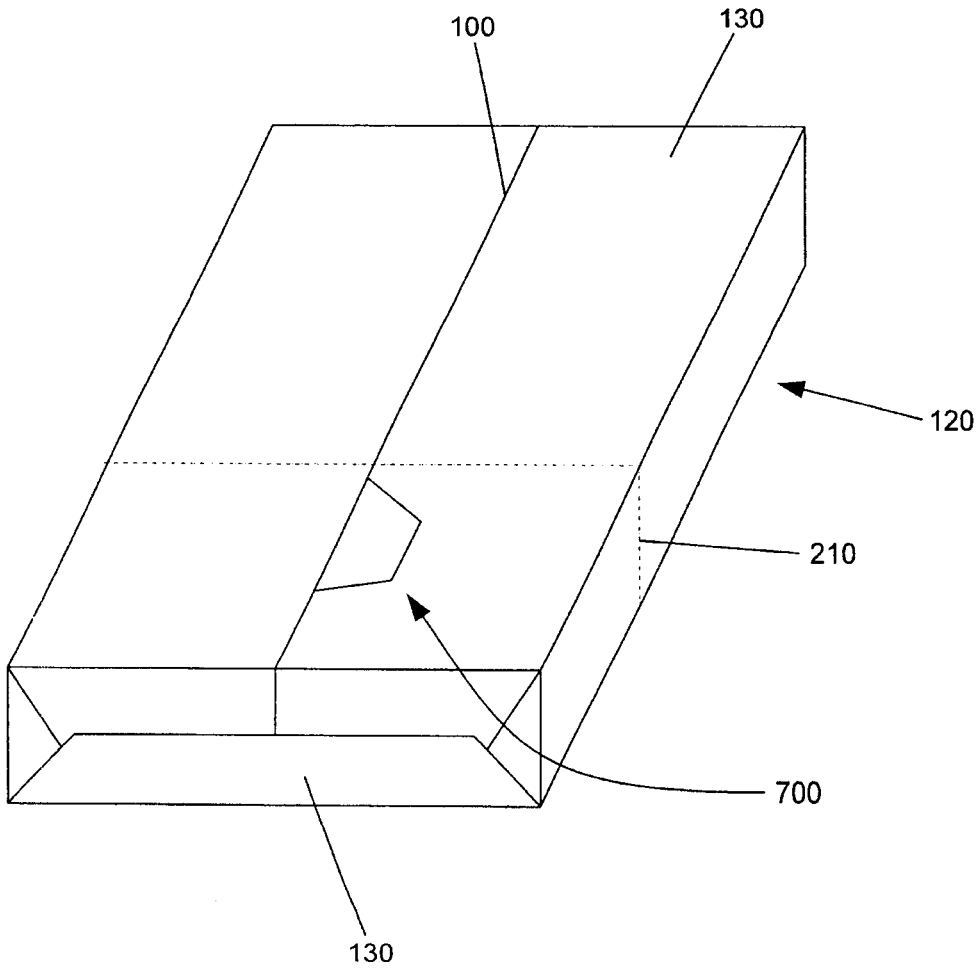
FIG. 7 is a perspective view of a ream of print media illustrating an alternative embodiment.

An alternative embodiment of the present print media wrapper is illustrated in FIG. 7. As shown in FIG. 7, a tab (700) may be formed as an integral part of the print media wrapper (120) just below the perforated seam (210). The tab (700) may be of the same material as the print media wrapper (120) or it may be a reinforced tab formed during the production of the print media wrapper. According to the alternative embodiment illustrated in FIG. 7, when a user desires to remove a portion of the print media wrapper (120), the integral tab (700) may be pulled, causing a tear of the print media wrapper to occur along a perforated seam (210). This tear may effectively separate a portion of the print media wrapper so that a pick-up mechanism (510; FIG. 5) may access the print media contained therein.

Figure 8:
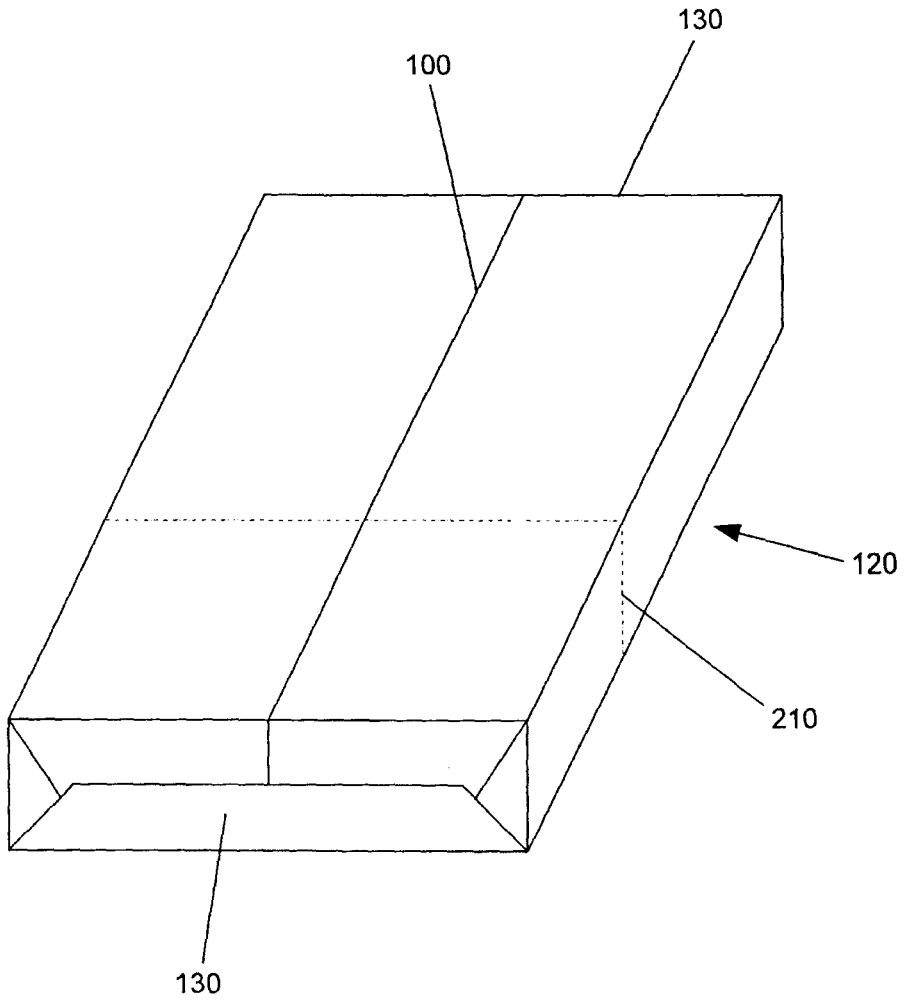
FIG. 8 is a perspective view of a ream of print media illustrating yet another alternative embodiment.

FIG. 8 illustrates yet another alternative embodiment of the present print media wrapper (120). As shown in FIG. 8, no tab (700; FIG. 7) or pull tab (200; FIG. 2) may be formed with the print media wrapper. According to the embodiment illustrated in FIG. 8, a perforated seam (210) may be disposed on the print media wrapper (120) to facilitate the removal of a predetermined portion of the print media wrapper (120). According to the alternative embodiment illustrated in FIG. 8, a user may use their hand or any other object to tear or rip the print media wrapper (120) along the perforated seam (210) thereby exposing a portion of print media. Once the print media wrapper (120) is removed sufficiently to expose the print media to a pick up mechanism (510; FIG. 5), the ream of print media may be inserted in the printing device as explained above.

Figure 9:
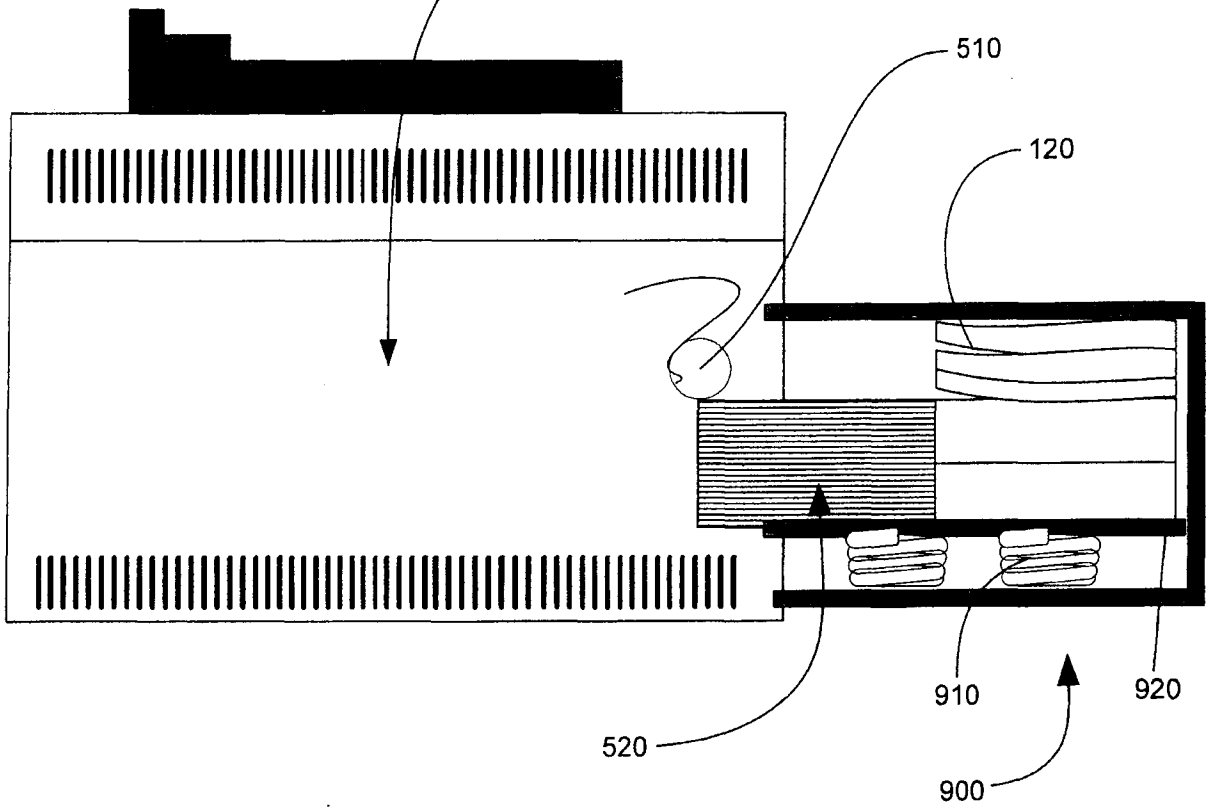
FIG. 9 is a cross-sectional view of a printing device incorporating a plurality of print media reams according to one exemplary embodiment.

FIG. 9 illustrates an alternative embodiment showing a printing device (500) including a high-capacity input tray (900) having a media tray (920) disposed on a biasing apparatus (910). The biasing apparatus (910) illustrated in FIG. 9 may be any biasing apparatus configured to implement a translational force on the media tray (920) including, but in no way limited to, a spring. As shown in FIG. 9, multiple reams of print media having a portion of the print media wrapper (120) removed so as to expose a portion of the print media (520) may be stacked on the media tray (920). As the pick up roller (510) extracts exposed print media (520), the biasing apparatus (910) may translate the media tray (920) and subsequently the exposed print media toward the pick up roller (510) to maintain a necessary contact pressure between the pick up roller and the exposed print media (520). When all of the exposed print media (520) has been extracted from a print media wrapper (120), the empty print media wrapper (120) may be forced upward and compressed by both the media tray (920) and the un-exhausted reams of print media. According to this embodiment, multiple reams of print media may be loaded in a single printing device while maintaining a portion of the print media wrapper on the print media for the reasons mentioned above.

In conclusion, the present print media wrapper provides adequate access to a ream of print media by a pick-up mechanism while simultaneously providing organizational support to the print media. Moreover, by allowing a portion of the print media wrapper to remain on the print media, a user is able to speedily position the print media such that the desired image is printed on the best surface according to the nap of the print medium.

The preceding description has been presented only to illustrate and describe embodiments of invention. It is not intended to be exhaustive or to limit the invention to any precise form disclosed. Many modifications and variations are possible in light of the above teaching. It is intended that the scope of the invention be defined by the following claims.

What is claimed is:

1. A method of packaging media used in a document producing device comprising;

sectioning a packaging wrapper surrounding said media;

providing a pull tab for separating said sectioning of said packaging wrapper for detaching a section of said packaging wrapper for exposing a portion of said media, while a second portion of said media remains in a second section of said packaging wrapper; and placing a label on said second section of said packaging wrapper that identifies at least one of a color and type of said media in said packaging wrapper, such that, when said media in said second section of said packaging wrapper is placed in said document producing device, said media is available to said document producing device while said label remains visible to a user of said document producing device to identify said media.

2. The method of claim 1, wherein said sectioning said packaging wrapper comprises forming a perforated strip in said packaging wrapper.

3. The method of claim 1, wherein said media comprises paper.

4. The method of claim 1, wherein said media comprises transparencies.

5. The method of claim 1, wherein said pull tab is made of a paper heavier than a paper used to form said packaging wrapper.

6. The method of claim 1, wherein said pull tab comprises string.

7. The method of claim 1, wherein said pull tab is made of plastic and secured to said packaging wrapper with an adhesive.

* * * * *